United States Patent [19]

Boyles

[11] 3,930,360

[45] Jan. 6, 1976

[54] ALARM CLOCK TIMER

[75] Inventor: Robert L. Boyles, Wayland, Mass.

[73] Assignee: General Electric Company, Bridgeport, Conn.

[22] Filed: June 21, 1974

[21] Appl. No.: 481,834

Related U.S. Application Data

[62] Division of Ser. No. 388,770, Aug. 16, 1973, Pat. No. 3,882,668.

[52] U.S. Cl. ..... 58/21.155

[51] Int. Cl.[2] ..... G04B 13/00

[58] Field of Search..... 58/21.15, 21.155, 21.16, 58/16, 19

[56] References Cited

UNITED STATES PATENTS

| | | | |
|---|---|---|---|
| 3,004,380 | 10/1961 | Sidell et al. | 58/21.155 |
| 3,308,617 | 3/1967 | Balchunas | 58/21.155 |
| 3,382,665 | 5/1968 | Bowden | 58/21.15 |
| 3,387,452 | 6/1968 | Ring et al. | 58/21.155 |

*Primary Examiner*—Lawrence R. Franklin
*Attorney, Agent, or Firm*—Leonard J. Platt; George R. Powers; John F. Cullen

[57] ABSTRACT

An alarm vibrator control mechanism for a clock timer wherein an elongated lever extends along the lower portion of the timer for releasing an alarm vibrator at a preset time. The elongated lever is controlled by a selector shaft mechanism which is positioned at one side of the timer, a centrally located 12 hour alarm time gear and a disc cam which is connected to a units shaft at the other side of the timer. The 12 hour alarm time gear tilts the vibrator shutoff lever forwardly a few minutes before the alarm time and then the disc cam moves a right side portion of the elongated lever downwardly at the alarm time to release the elongated alarm shutoff lever from a notch which is formed in a base plate to sound the alarm. A repeat alarm lever cooperates with a tab of the elongated lever to automatically shut off the alarm for a short time interval.

4 Claims, 15 Drawing Figures

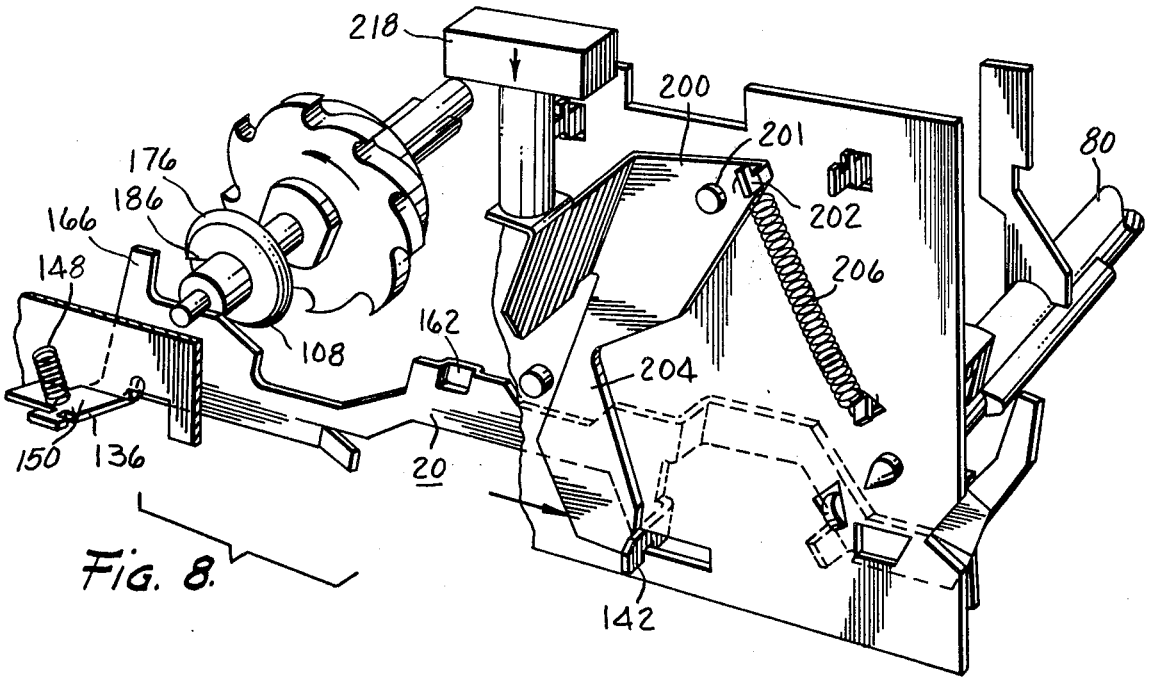
FIG. 8.
FIG. 9.
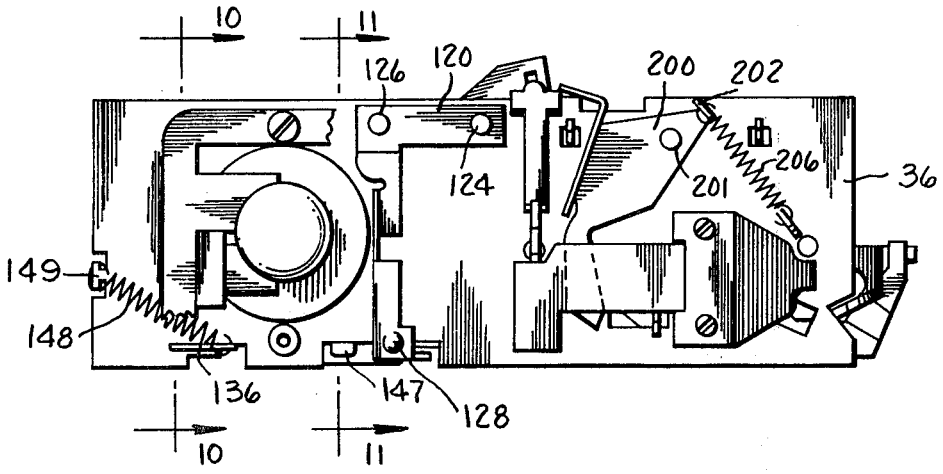
FIG. 10.
FIG. 11.
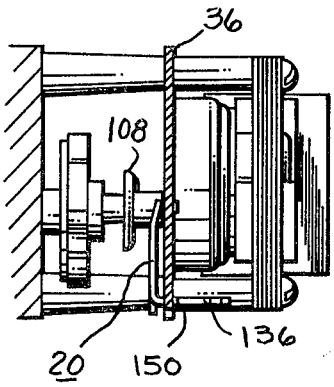
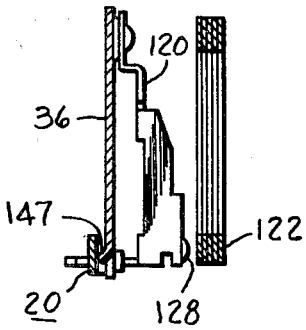

ALARM CLOCK TIMER

This is a division of application Ser. No. 388,770, filed Aug. 16, 1973, now U.S. Pat. No. 3,882,668.

BACKGROUND OF THE INVENTION

1. Field of the Invention

This invention relates to a clock timer, and more particularly to an improved vibrator control lever mechanism which is actuated by both a 12 hour cam mechanism and a units mechanism to reliably and accurately release an alarm vibrator at the alarm time and a repeat alarm mechanism which cooperates with the control lever mechanism to shut off the alarm for a short time interval.

2. Description of the Prior Art

Radio digital alarm clock timers are now known in the horological art. Such radio alarms are generally designed to close a switch at a pre-selected time, and a known timer of this type is shown in a recent U.S. Pat. No. 3,725,617 to Boyles and Polonsky dated Mar. 20, 1973, assigned to the same assignee as the present invention. As shown in the patent, a rotatable units cam is positioned adjacent to a minutes display indicator for progressively actuating the minutes display indicator, a rotatable tens cam is spaced to the left of the units cam for actuating the tens of minutes display indicator and a rotatable hours cam is spaced to the left of the tens of minutes cam for actuating an hours display indicator.

A pair of coaxially mounted gear driven cam members with one of the cam members being axially movable is utilized for operating a switch mechanism at a preset alarm time to turn on a radio or a similar appliance at the preset alarm time. This invention is concerned with the addition of a vibrator type alarm mechanism to such a clock timer which may be operated by the same mechanism which operates the switch for a radio and the display indicators of the clock.

The prior art includes many different constructions and arrangements for controlling an audible alarm vibrator by itself or in combination with a switch for turning a radio ON and OFF. Some of these mechanisms are quite complex. My invention is concerned with a relatively simple alarm vibrator control mechanism for such a clock timer which may be inexpensively manufactured and readily incorporated in a digital clock of the type disclosed in the U.S. Pat. No. 3,725,617; however, it is to be understood that it may also be utilized in other digital clock timer mechanisms or hand-type clock timer mechanisms.

Accordingly, it is a primary object of my invention to provide an improved reliable vibrator control mechanism for a clock timer which includes relatively few parts which may be readily manufactured and assembled to each other.

It is also an object of my invention to provide a vibrator control mechanism which may be conveniently operated and which may be easily combined with a digital clock of the type disclosed in the above mentioned patent.

SUMMARY OF THE INVENTION

In accordance with one of the aspects of this invention, an alarm clock timer includes a supporting structure and a timing mechanism for continuously applying a driving force to the components of the clock timer mechanism. The clock timer includes a vibrator member for sounding an alarm which is connected to the supporting structure, and is movable to an alarm ON or an alarm OFF position. An elongated alarm control lever is also mounted on the supporting structure and is movable into engagement with the vibrator member for shutting OFF the alarm. A spring is connected to the elongated alarm control lever for urging the lever to the alarm ON position and a latch is formed on the lever for holding the lever in the alarm OFF position. The elongated alarm control lever is uniquely mounted at the lower portion of the timer and it includes a centrally located tab for movement into contact with the alarm vibrator member. A central portion of the elongated control lever is also shaped and positioned for control by a 12 hour alarm cam gear member. One end portion of the elongated control lever is located adjacent to a minutes cam for control thereby, and another end portion is positioned adjacent to a manually operable selector cam setting member. The alarm control lever is mounted for longitudinal movement to move the alarm vibrator to an alarm sounding position. It is also loosely mounted for tilting movement and for transverse movement. A few minutes before the alarm time, a 12 hour cam member tilts the elongated alarm control lever into engagement with the cam which is connected to the minutes shaft, and then the minutes shaft cam which is located close to the latch lowers the alarm control lever at the preset alarm time to disengage the latch to permit the elongated alarm control lever to move longitudinally under the force of the spring to sound the alarm alarm lever is positioned for actuating a tab on the elongated lever to automatically shut off the alarm for a short time interval.

By this arrangement, the 12 hour alarm cam gear operates on the central portion of the elongated alarm control lever to readily tilt the entire lever reliably forwardly into engagement with the minutes cam. Thus, the lever is held with sufficient force into contact with the minutes cam gear so that the minutes cam gear may readily and reliably lower the elongated lever to accurately release the latch at the preset alarm time. In addition, since the minutes cam and the latch are both located at one end portion of the elongated lever, the minutes cam may readily and reliably lower the lever at the alarm time although the elongated vibrator shutoff lever may be quite loosely mounted on the timer supporting structure with relatively great tolerances. Moreover, the repeat alarm mechanism may be readily positioned for operating a tab of the elongated lever.

With this unique construction, relatively few parts are required for adding an alarm vibrator function to the digital clock mechanism disclosed in the prior U.S. Pat. No. 3,725,617. A unique units cam member is readily attached to the units digital display mechanism for moving the lever to release the latch, and the uniquely shaped elongated alarm control lever may be readily slid into the timer supporting structure and held thereon without the use of any separate supporting mechanisms. The alarm control lever is simply provided with slots and tabs for cooperating with corresponding slots and tabs which are formed on the supporting structure. A spring extends from the lever to the supporting structure for biasing the alarm control lever to the alarm ON position.

BRIEF DESCRIPTION OF THE DRAWINGS

Other objects and attendant advantages of the invention will be apparent from the following description taken in connection with the accompanying drawing in which:

FIG. 2 is a fragmentary exploded front perspective view of a portion of my unique alarm vibrator control mechanism which is incorporated in the digital clock shown in FIG. 1, the parts of my vibrator control mechanism being shown in a position wherein they are under the control of an alarm selector cam, the parts being shown in a NO-WAKE position wherein they are prevented from operating to sound the vibrator or to close the switch of the alarm clock timer to turn a radio on;

FIG. 8 is a fragmentary exploded rear perspective view generally similar to FIG. 7 showing a repeat alarm lever being actuated to move the vibrator shutoff lever longitudinally against the force of its spring to shut off the alarm vibrator for a predetermined short interval of time, the parts being shown as the repeat alarm lever moves into engagement with the vibrator shutoff lever but before the shutoff lever is moved from its position illustrated in FIG. 7 to its position illustrated in FIG. 6;

FIG. 9 is a rear elevational view of the digital clock timer shown in FIG. 1, showing the repeat alarm lever in its at rest position;

FIG. 10 is a detailed side cross-sectional view of a portion of the minutes drive mechanism for the vibrator shutoff lever of the digital clock shown in FIG. 1;

FIG. 11 is a detailed side cross-sectional view of the vibrator and the field laminations of the digital clock shown in FIG. 1;

DESCRIPTION OF THE PREFERRED EMBODIMENT

Figure 1:
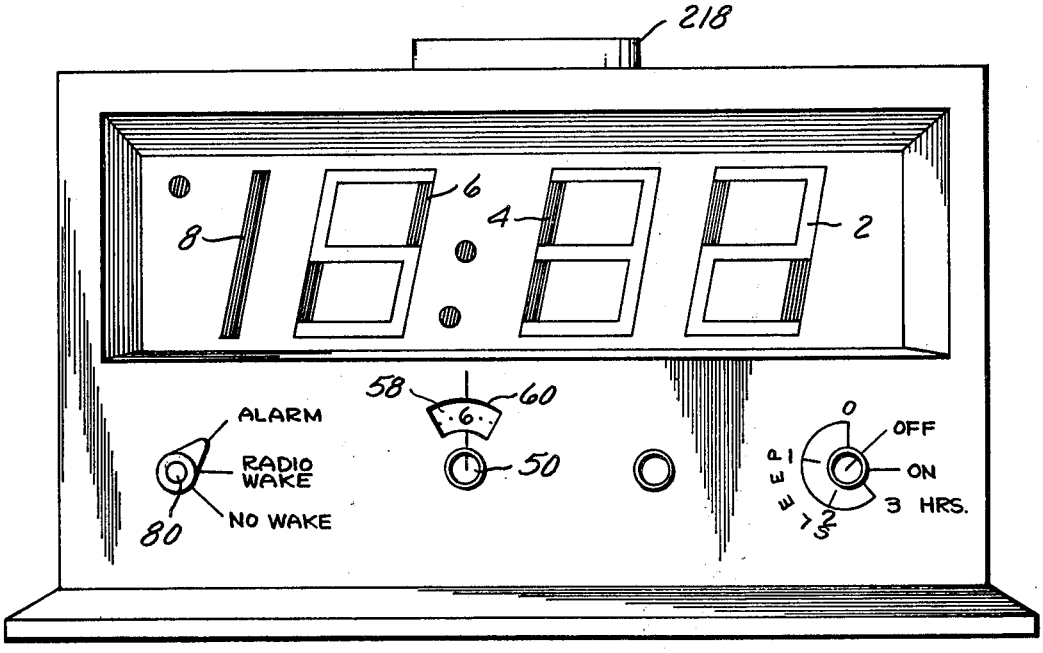
FIG. 1 is a front elevational view of a digital alarm clock timer constructed in accordance with my invention.
Figure 2:
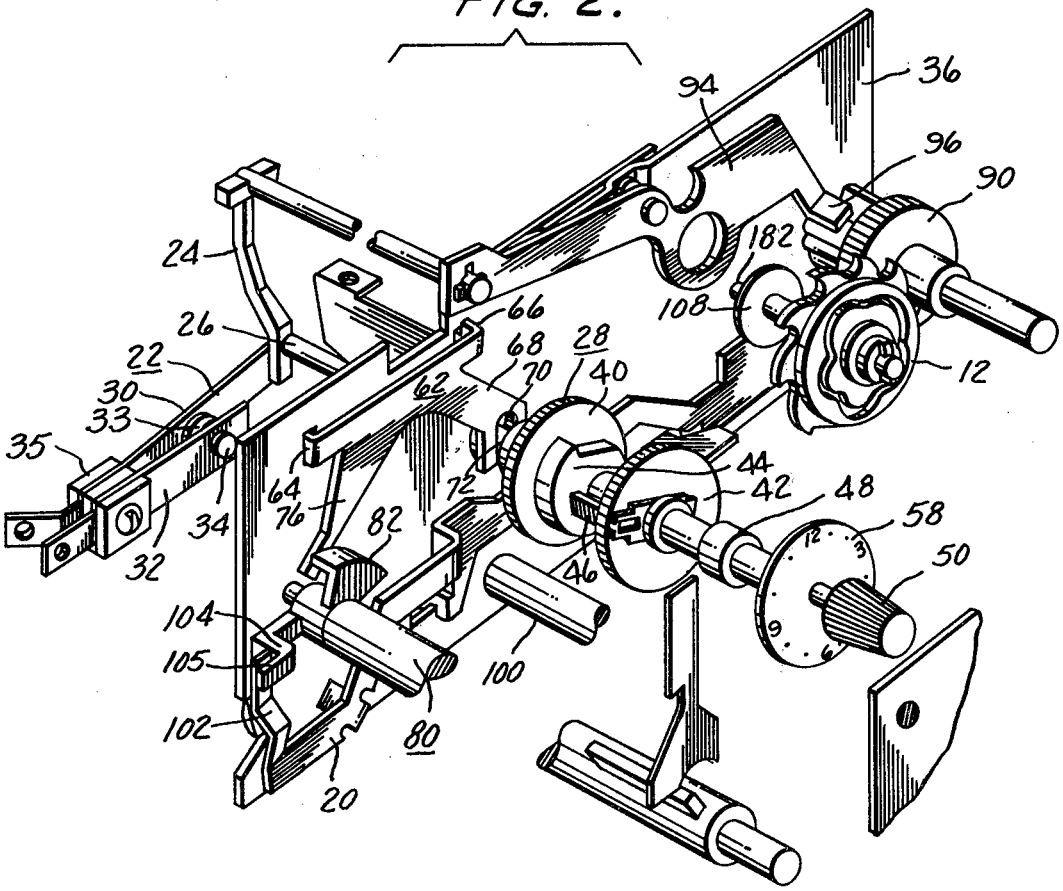
Figure 3:
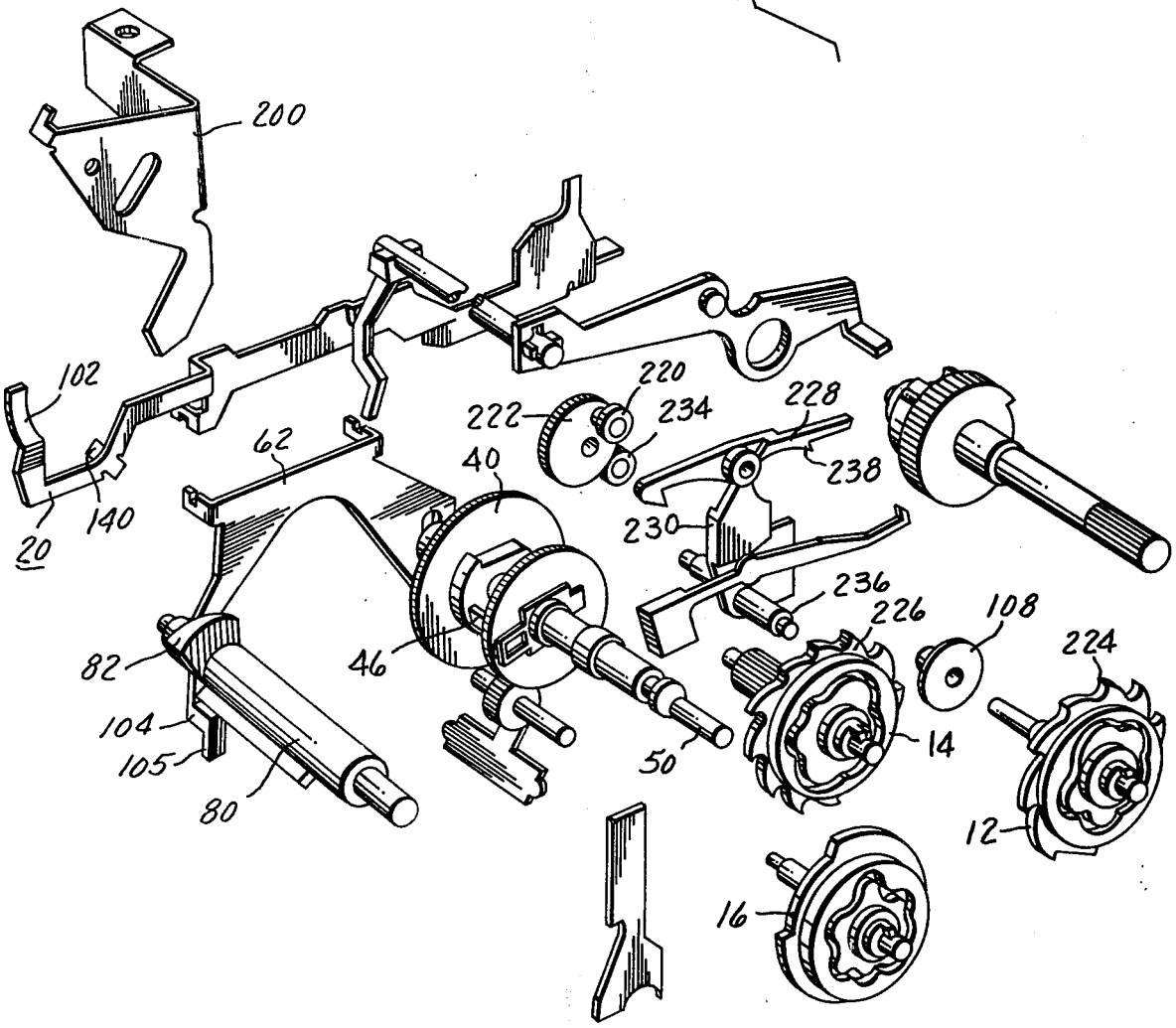
FIG. 3 is a fragmentary exploded front perspective view generally similar to FIG. 2 including some parts of the display mechanism of the clock.
Figure 12:
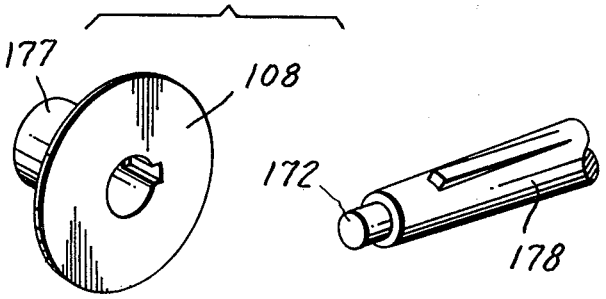
FIG. 12 is a fragmentary exploded perspective view of the minutes cam construction for the vibrator shutoff lever of the digital clock shown in FIG. 1.

Referring now to the drawing, and first particularly to FIGS. 1 and 2, there is shown a digital clock which includes my unique alarm vibrator control mechanism. The clock includes four numeral display indicators 2, 4, 6 and 8 which indicate minutes, tens of minutes, hours and tens of hours, respectively. With reference to FIG. 3, portions of the cams and other mechanisms for driving the display indicators are shown by reference numerals 12, 14, and 16, and my improved alarm vibrator control mechanism is generally identified by reference numeral 20.

The details of the digital display indicators 2, 4, 6 and 8, and the details of the mechanism for indexing and driving the minutes, tens of minutes, and hours cams 12, 14, and 16, respectively, do not form a part of this invention and are described and illustrated in greater detail in U.S. Pat. No. 3,721,087 to Boyles and Polonsky dated Mar. 20, 1973 assigned to the same assignee as the present invention. However, it should be understood that the minutes cam 12 is driven at one revolution every ten minutes, and the hours cam 16 is driven at one revolution every 12 hours.

With reference to FIG. 2, the clock timer includes a switch alarm mechanism for turning on a radio. The construction includes a switch 22, switch actuating members 24 and 26, and a 12 hour alarm time cam mechanism 28. This mechanism is described and illustrated in greater detail in U.S. Pat. No. 3,725,617 to Boyles and Polonsky dated Apr. 3, 1973, assigned to the same assignee as the present invention. As shown, the switch 22 includes a pair of switch blades 30 and 32 having a pair of switch contacts 33 and 34 mounted at their free end portions. Rear switch blade 30 is somewhat longer than the front switch blade 32 and is formed of spring material for normally biasing the rear switch blade forwardly to hold the switch contacts in a closed position. The switch blades may be mounted on a conventional switch block member 35 which may be connected to a rear plate 36 of the digital clock by any suitable securing means. As shown, the switch 22 is mounted so that the switch blades 30 and 32 are arranged in planes which are generally parallel to the base plate 36. With this arrangement, rearward or transverse movement of the free end portion of the switch blade 30 will open the switch contacts.

As shown in FIG. 2, one of the switch actuating members is a generally vertical lever member 24 which is positioned between the rear switch blade 30 and the base plate 36 for opening or closing the switch in response to movement of the 12 hour alarm time cam mechanism 28, and particularly, its rearwardly extending shaft member 26 which abuts the lower portion of lever 24. It can be appreciated that rearward movement of the switch actuating lever 24 by shaft 26 will cause the lower portion of the lever to abut the front surface of switch blade 30 and further rearward movement of the lever will cause the switch blade 30 to be moved far enough rearwardly to open the switch contacts 34 and 33.

The alarm cam mechanism 28 for allowing the switch actuating lever 24 to be moved forwardly at a preset alarm time to thereby turn on a radio or other alarm at a preset time will now be more particularly described. Basically, the alarm cam mechanism 28 includes two coaxially mounted gears 40 and 42 which are provided with interacting cams 44 and 46, respectively, for causing relative axial movement of the gears at a preset time for actuating the switch 22. Cam gear 44 functions as an alarm time cam and is driven at one revolution every 12 hours by the timing mechanism of the clock. Cam 42, 46 is an alarm set cam and it is fixed to a shaft 48 which extends forwardly and rearwardly therefrom. A knob 50 may be fixed to the forward end of the shaft 48 for manually rotating the alarm set cam 42, 46 to any desired alarm time.

A relatively simple alarm set time indicator may be incorporated with the alarm set cam 42 for indicating the alarm set time. As shown more particularly in FIGS. 1 and 2, the principal component of the indicating mechanism is a disc 58 which may be readily snapped onto an outer portion of the shaft 48 for cooperation with a suitable slot 60 which may be formed in the front casing of the digital clock for viewing the hours numerals which are formed on the indicating disc.

In the more conventional alarm time cam and alarm set cam gear arrangements, such as the one disclosed in a prior U.S. Pat. No. 3,432,625 to Polonsky dated Mar. 11, 1969, assigned to the same assignee as the present invention, a cam finger is fixed to a rotatable alarm set gear for cooperating with a slot which is formed in a continuously rotatable alarm time cam gear. With the arrangement shown in the Polonsky patent a cam finger 24 snaps into a cam slot 30 at an alarm time, and then the cam finger 24 drives out and separates the cam gears in about 45 to 90 minutes. Naturally, such a drive-out movement would require a higher torque motor than would normally be required for simply rotating the hands of a clock.

In order to keep the torque requirements of the motor as low as possible it is preferred that the manual reset arrangement disclosed in a co-pending application of Robert L. Boyles and Samuel Polonsky, Ser. No. 241,963, now U.S. Pat. No. 3,740,502 be utilized with the alarm vibrator control mechanism disclosed in the instant case. As described more particularly in the co-pending application of Robert L. Boyles and Samuel Polonsky, the cam finger 46 is not fixed to the alarm set cam 42 but is resiliently mounted in a slot which is provided in the gear. A NO WAKE, RADIO WAKE, ALARM selector mechanism 80 is provided for moving the alarm time cam gear 40 rearwardly to position the finger 46 on the front surface of cam 44. As shown more particularly in FIG. 2, the mechanism includes a bifurcated lever 62 which is pivoted by tabs 64 and 66 to the mounting plate 36 of the digital clock. One downwardly extending arm 68 of the lever includes a U-shaped slot 70 for receiving an annular groove 72 which is formed in the shaft portion of the alarm time cam 40. The other left arm 76 of the lever 62 extends downwardly into a position to be actuated by a NO WAKE, RADIO WAKE, ALARM cam 82.

ON-OFF SLEEP

A manually setable SLEEP-ON-OFF cam mechanism 90 may also be provided for controlling the switch operating lever 24. This mechanism is described in more detail in U.S. Pat. No. 3,725,615 to Robert L. Boyles and Samuel Polonsky, and with particular reference to FIG. 2, it can be seen that the mechanism includes a pivoted plural position lever 94 which may be provided with a forwardly extending tab 96 for riding on the surface of an ON-OFF-SLEEP cam 90.

The switch actuating lever 24 is shaped and positioned so that it may be manually pushed downwardly at any time to close the switch without disturbing the position of shaft 26. To achieve this, an upper end portion is pivoted to the plural position lever 94 which in turn is arranged to be actuated by the ON-OFF-SLEEP cam 90. As illustrated in FIG. 2, the upper end of the switch actuating lever 24 is formed with a forwardly extending shaft portion which is received by an aperture which is formed in the plural position lever 94. A conventional pivot may be provided for generally centrally supporting the plural position lever 94, and it can be appreciated that upon rotational movement of the sleep cam 90, the lever 94 may be moved upwardly and downwardly to change the position of the switch actuating lever 24 with respect to the switch blade 30.

ALARM VIBRATOR CONTROL MECHANISM

According to my invention, there is uniquely combined with the aforedescribed radio alarm clock timer mechanism, a mechanism for automatically and very accurately sounding an audible alarm vibrator at a preset alarm time after the radio alarm time. This mechanism is constructed so that it may be uniquely positioned within the radio alarm timer with the use of relatively few additional parts. The primary component of this mechanism is an elongated vibrator shutoff lever 20 which stretches along the lower edge of the base plate 36 and is shaped to avoid several posts and shafts. It is also shaped to be selectively movable into engagement with control portions of the alarm clock timer, and with particular reference to the FIG. 2 front perspective view, it can be seen that the shutoff lever 20 is shaped to avoid a lower spacer post 100, and is also shaped with an upstanding generally vertical finger portion 102 for engagement with a radial finger 105 of the alarm selector cam member 80. The elongated lever 20 is also arranged to be selectively moved into engagement with the centrally located 12 hour alarm time cam gear 40, and a minutes cam 108 which is positioned at the right side of the timer and rotated at one revolution every ten minutes.

Since many of the critical components of the elongated vibrator shutoff lever 20 extend through slots which are formed in the base plate 36, and since the base plate and the elongated shutoff lever are located at the lower rear of the alarm clock timer, the shape of the elongated lever and the manner in which it cooperates with the other parts of the radio alarm clock timer may best be seen in the FIGS. 4, 5, 6, 8 and 9 rear perspective views of the alarm clock timer. Naturally, in looking at the rear perspective views, the right end portion 110 of the vibrator control lever is shown at the left of the drawing while the left end portion 112 of the vibrator control lever 20 is shown at the right side of the drawing. In order to maintain complete consistency throughout the specification and claims, the end portion 110 will always be referred to as the right end portion while the end portion 112 will always be referred to as the left end portion in spite of the fact that the parts will appear reversed in the rear perspective views of FIGS. 4 through 9.

Figure 4:
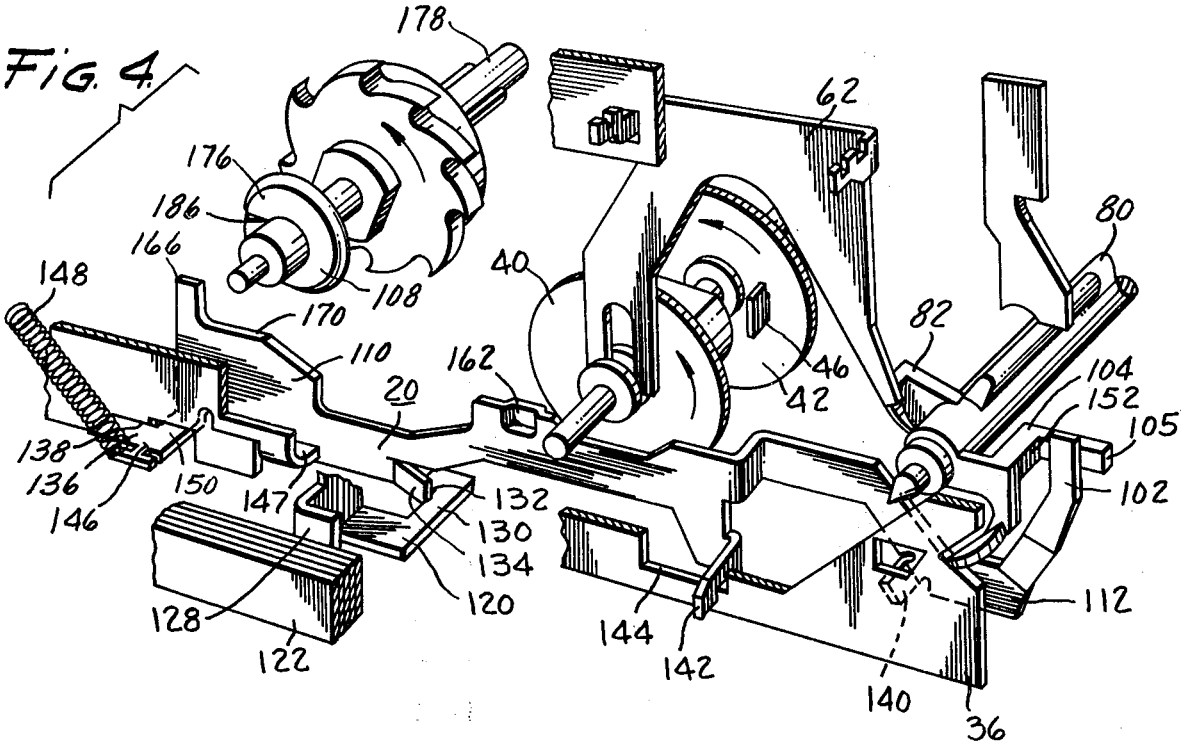
FIG. 4 is a fragmentary exploded rear perspective view of my alarm vibrator control mechanism which is incorporated in the digital clock shown in FIGS. 1, 2, and 3, the parts of the vibrator control mechanism being shown in a position wherein the alarm selector member has been rotated to a NO-WAKE position for holding the vibrator control mechanism in the OFF position.
Figure 5:
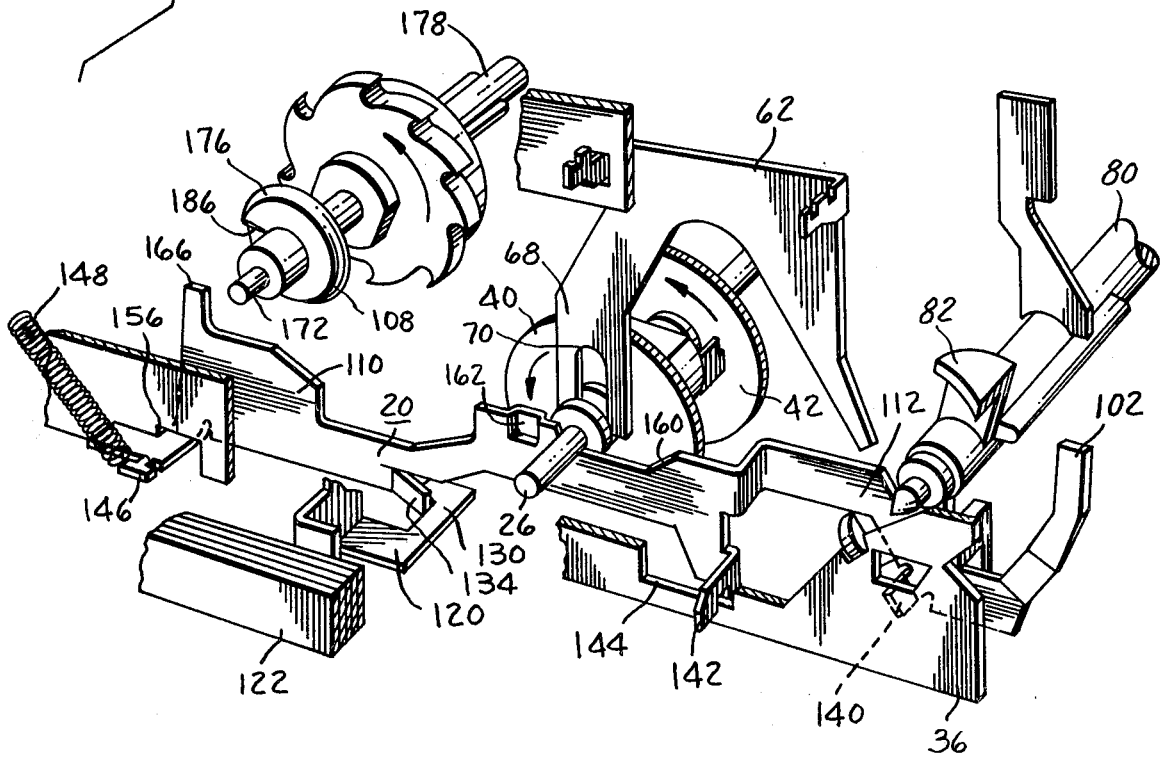
FIG. 5 is a fragmentary exploded rear perspective view similar to FIG. 4 showing the alarm selector cam in the ALARM position wherein the parts have been set to permit the alarm vibrator to sound at a preset time.

The principal function of the vibrator shutoff lever 20 is to permit or prevent the sounding of an audible alarm vibrator member 120 against the field laminations 122. With reference to FIGS. 4 and 9, the vibrator 120 may be fixed to the upper portion of base plate 36 by means of two rivets 124 and 126. As shown, it extends generally vertically downwardly and its lower end is formed with a rearward tab 128 for contact with the field laminations 122. As shown more particularly in FIG. 4, the lower portion of the vibrator includes a forwardly extending tab 130 which is formed with a cutout portion having an inclined surface 132 for engagement with a rearwardly lanced tab 134 that is struck from the shutoff lever 20.

The vibrator shutoff lever 20 is very loosely mounted on the supporting structure and because of the relationship of its control tabs and parts to each other, it may be formed with relatively great manufacturing tolerances. The right end portion of the lever is formed with a tab 136 that extends rearwardly of the base plate 36, and it has a forward surface 138 for cooperating with the rear surface of the base plate to limit forward movement of the right end portion of vibrator shutoff lever. The principal portion of the lever is located in front of the base plate 36 and is provided with a rearwardly extending tab 140 at its left portion for contact with the front surface of the plate to limit rearward movement of the shutoff lever. A pivot for the left portion of the lever is achieved by a pivot tab 142 which extends rearwardly and is received by a slot 144 which is formed in the base plate. The right portion of the elongated shutoff lever 20, and particularly the tab 136, is also provided with a notch 146 for receiving one end of a spring 148 to bias the lever in a rightward direction (leftward as shown in FIG. 4) to its vibrator sounding position. As shown in FIG. 4, a forwardly struck tab 147 may also be provided on the base plate 36 to limit rearward movement of the lever 20 and to act as a pivot surface for the lever.

The vibrator shutoff lever 20 has three modes of freedom. It can move longitudinally to the right or the left to permit the vibrator 120 to sound or to prevent the vibrator from sounding. It can tilt forwardly about a hinge line close to the bottom edge of the base plate 36 to move into engagement with a minutes shaft cam 108, and it can also be moved transversely downwardly, particularly at its right portion 110, for releasing a latch 150 that holds the lever in the vibrator shutoff position.

As shown more particularly in FIG. 4, the shutoff lever 20 is held in its NO WAKE position by a finger 104 of the selector cam 80. It can be seen that an axially extending surface 152 of the finger has been rotated into contact with the upwardly extending finger 102 of the vibrator shutoff lever 20 to move the lever to the left against the force of spring 148. During this movement, the tab 134 of the shutoff lever slides on the inclined surface 132 of the vibrator 120 to pull the vibrator tab 128 forwardly to thereby prevent it from sounding against the field laminations 122.

Figure 7:
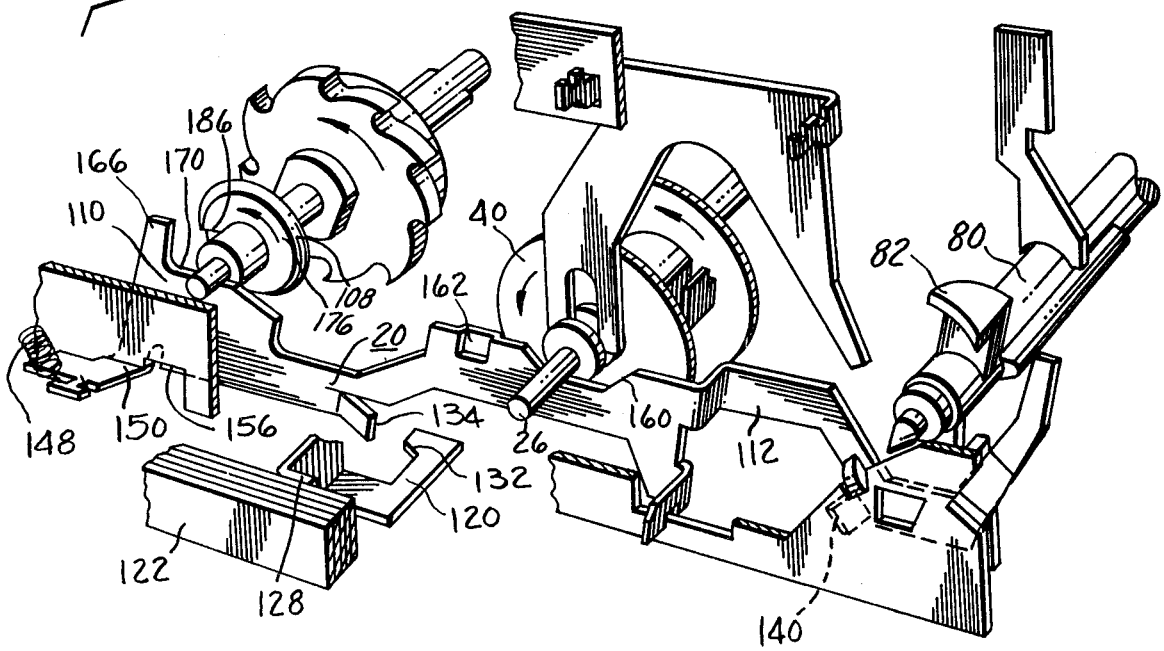
FIG. 7 is a fragmentary exploded rear perspective view generally similar to FIG. 6 showing the vibrator control lever after it has been moved downwardly to release the latch at the alarm time.

As shown in FIGS. 7 and 10, the right portion of the vibrator shutoff lever 20 is provided with a latch tab 150 that extends between the principal portion of the shutoff lever and its right rear tab 136 for holding the lever 20 in latching engagement within an upwardly extending notch 156 that is formed in the base plate 36. With this construction, the vibrator shutoff lever 20 is held to prevent the vibrator 120 from sounding when the selector cam member 80 is rotated counterclockwise from the NO WAKE position shown in FIG. 4 to the ALARM set position shown in FIG. 5. It can be appreciated that when the alarm selector cam member 80 is moved counterclockwise, the radially extending finger 104 will be moved from its upper position shown in FIG. 4 to its lower position shown in FIG. 5 wherein its surface 152 does not abut finger 102 of the vibrator shutoff lever, and thus, the lever 20 is permitted to move a slight increment to the right, depending on manufacturing tolerances, under the influence of spring 148 until it rests against a right inside surface of the latch notch 156.

The central portion of the vibrator shutoff lever 20 is provided with a notched out portion 160 for receiving shaft 26 of the alarm time cam gear 40 and a slide tab 162 for cooperating with the rearward surface of the alarm time cam 40. To achieve this, the lever 20 is stamped with a relatively small forwardly extending protrusion 162 adjacent to the notched out portion 160 for slidable engagement with the rear surface of the alarm time cam gear 40. With particular reference to FIGS. 4 and 9, it can be appreciated that the spring 148 is anchored at one of its ends 149 to an upper portion of the base plate 36 and thus, in addition to pulling the tab 136 to the right, it lifts the tab 136 and tilts the upper portion of the lever forwardly to hold the protrusion 162 into engagement with the rear surface of gear 40.

From the foregoing discussion of the alarm time and alarm set cams 40 and 42, and from a detailed discussion of these components in the co-pending application of Boyles and Polonsky (6D-4327), Ser. No. 241,963, filed Apr. 7, 1972, it can be appreciated that the 12 hour alarm time cam gear 40 will be moved forwardly at the alarm set time, and from the foregoing discussion and a more detailed discussion in the U.S. Pat. No. 3,725,617 to Boyles and Polonsky, it can also be appreciated that this movement will move shaft 26 forward to close switch contacts 34 and 33 to turn the radio on at the alarm time which has been preset by the 12 hour alarm set cam 42. This same forward movement of the alarm cam gear 40 tilts the upper portion of the vibrator shutoff lever 20 forwardly, and particularly the upper right portion 110 thereof, into slidable engagement with a minutes cam 108 to permit the minutes cam to accurately sound the alarm vibrator a short time thereafter. This position of the alarm vibrator shutoff lever is shown more particularly in FIG. 6.

MINUTES CAM

The upper right portion 110 of the vibrator shutoff lever 20 is provided with an upwardly extending tab 166 for engagement with the minutes shaft cam 108 when the 12 hour alarm time cam gear 40 has moved forwardly to tilt the lever 20 into engagement with the minutes cam 108. As shown more particularly in FIGS. 6 and 7, the vibrator shutoff lever 20 is provided with a curved cutout portion 170 for very freely receiving the shaft 172 of the minutes cam 108 so that the small upwardly extending cam finger 166 may readily slide in engagement with an annular cam surface 176 of the minutes cam 108.

With particular reference to FIGS. 2, 6, 7, and 12, it can be seen that the vibrator alarm minutes cam 108 includes a forwardly extending hollow shaft portion 177 for receiving a minutes cam drive shaft 178 which may be integrally formed with the cam 12 which drives the minutes display indicator 2, a cam disc portion 176, and a rearwardly extending shaft portion 172 for reception in an aperture 182 which is formed in the base plate 36. As shown, the cam portion 176 is annular in shape, it extends for 360° close to the periphery of the disc on the rear surface of the disc, and it includes an abrupt trigger shelf portion 186 for engagement with the upper surface of the tab 166 to move the tab 166 and the vibrator shutoff lever downwardly to release the latch 150 of the vibrator shutoff lever from the notch 156 in the base plate at a precise number of minutes after the radio alarm time. This released position is shown more particularly in FIG. 7 and it can be appreciated that when the latch is released, spring 148 will cause the alarm shutoff lever 20 to be moved to the right (to the left as shown in FIG. 7) to release the alarm vibrator 120 to thereby permit the alarm to sound. The angular orientation of the shelf portion 186 is preferably such that the release of the latch lever 20 occurs as the units digit 9 appears at the display indicator 2.

REPEAT ALARM

In accordance with my invention, a repeat alarm mechanism may be readily added to the alarm clock timer with the addition of relatively few parts. With such a mechanism the vibrator 120 may be shutoff to permit the radio to continue to play, and then the minutes cam timing mechahism 108 can operate to resound the audible alarm vibrator 120 exactly ten minutes after the original sounding, just to make sure the user has not fallen asleep.

As shown more particularly in FIGS. 8 and 9, the principal component of the repeat alarm mechanism is a bell crank lever 200 which is pivoted on the back of the base plate 36 by means of a rivet 201 or other suitable pivot construction. As shown, the repeat bell crank lever 200 includes a rearwardly extending tab 202 for receiving one end of a spring 206 which pivots the bell crank lever in a counterclockwise direction (clockwise as shown in FIG. 8). The bell crank lever 200 also includes a downwardly extending arm 204 for uniquely operating against the pivot tab 142 of the vibrator shutoff lever 20 to recock the vibrator shutoff lever on the latch tab 150 after the alarm has sounded.

With this construction, it can be appreciated that after the alarm has sounded and the parts have moved to the position illustrated in FIG. 7 to permit the vibrator tab 128 to vibrate against the field laminations 122, downward movement of the right side (left as shown in FIG. 8) of the repeat alarm lever 200 will move its finger 204 to the left (right in FIG. 8) to engage pivot tab 142 to move the entire vibrator shutoff lever 20 to the left (right in FIG. 8) to pull the vibrator 120 forwardly to shut off the alarm and to reset the latch 150 within notch 156. With this movement, the upwardly extending trigger finger 166 of the vibrator shutoff lever will be moved into engagement with the surface 176 of the minutes cam 108, and then the shelf 186 of the minutes cam will push the right end portion of the vibrator shutoff lever downwardly within ten minutes thereafter to permit the vibrator 128 to resound against the field laminations 122.

AUTOMATIC REPEAT ALARM MECHANISM

Figure 13:
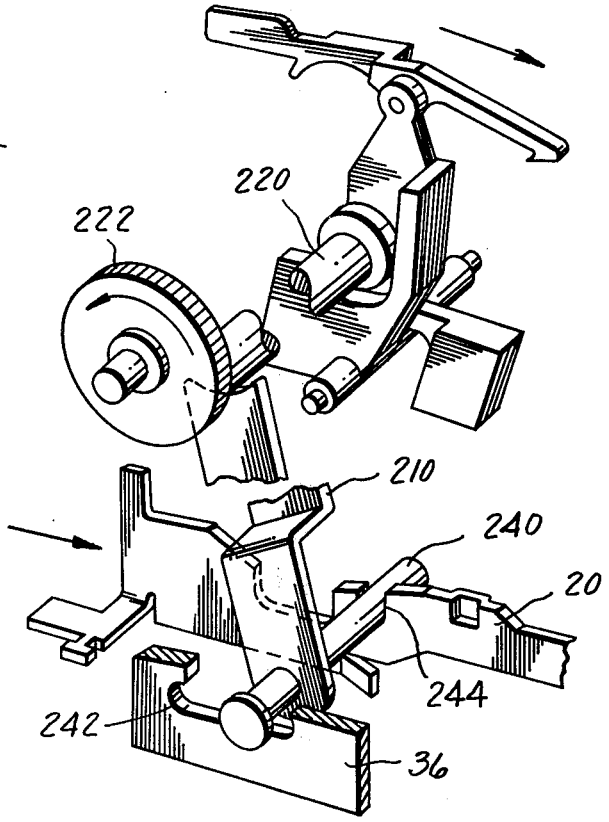
FIG. 13 is a fragmentary exploded rear perspective view showing a repeat alarm modification of the digital clock shown in FIG. 1.
Figure 14:
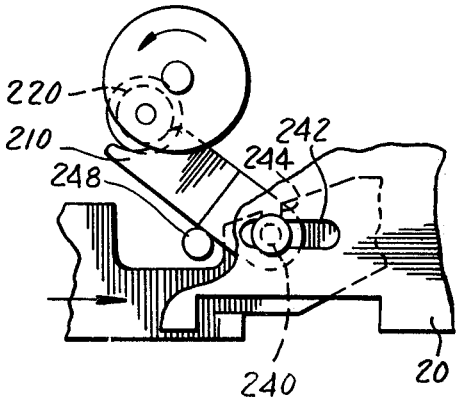
FIG. 14 is a fragmentary rear elevational view of a portion of the modified repeat alarm mechanism shown in FIG. 13 showing the alarm vibrator shutoff lever in its alarm sounding position with the repeat alarm mechanism starting to move the vibrator shutoff lever to its alarm OFF position.
Figure 15:
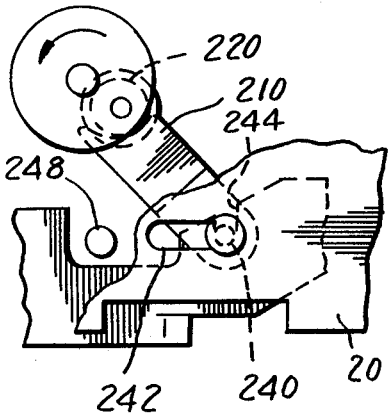
FIG. 15 is a fragmentary rear elevational view of the shutoff lever and the repeat alarm mechanism after the parts have been moved to the alarm OFF position.

As shown more particularly in the modification illustrated in FIGS. 13, 14 and 15, an automatic repeat alarm mechanism may be added to the digital alarm clock timer in place of the manual repeat mechanism which includes the bell crank lever 200. This mechanism can be readily actuated by a drive roller 220 which is normally provided on a one revolution per minute gear 222 that actuates the minutes display indicator cam 12. The drive roller mechanism for driving the minutes display indicator cam 12 is described and illustrated in greater detail in U.S. Pat. No. 3,721,087 to Boyles and Polonsky dated Mar. 20, 1973, and as shown in FIG. 3, the drive roller mechanism 220 is positioned between the minutes and tens cams 12 and 14 for indexing the minutes cam once every minute and for simultaneously indexing the tens cam one increment at the instant that the minutes cam is indexed a tenth increment. With this construction, the minutes cam and the tens cam are simultaneously indexed to the next succeeding numbers when the units cam is being moved to its tenth increment. To achieve this, special cam teeth 224 and 226 are integrally formed on the outer periphery of the cams 12 and 14 for cooperating with a pawl lever 228 which is positioned between the cams. As shown more particularly in FIG. 3, the indexing mechanism includes a drive lever 230 which is pivotally mounted on the digital clock between the units and tens cams 12 and 14.

The drive roller mechanism 220 is provided for oscillating the drive lever 230 to provide a rapid clockwise advance stroke of about five seconds duration and a slower return stroke once per minute. To accomplish this, the drive lever 230 is provided with cam surfaces for cooperating with the eccentric drive roller 220 which is mounted on the gear 222 that is rotated at one revolution per minute by a synchronous electric motor pinion 234. The gear 222 and its eccentric roller 220 are rotated in a clockwise direction and the roller 220 abuts a cam surface to pivot the upper portion of the drive lever 230 to the right to move a units pawl 238 of the pawl lever 228 to the right. With reference to FIG. 3, the pawl 238 move a tooth of the units cam 12 to move the units cam one increment to thereby actuate the units display indicator 2 to display a next succeeding numeral. Continued rotation of the eccentric roller 220 moves the roller into contact with a return stroke cam surface to move the drive lever 230 and the pawl lever 228 to the left as shown in FIG. 3.

Figure 6:
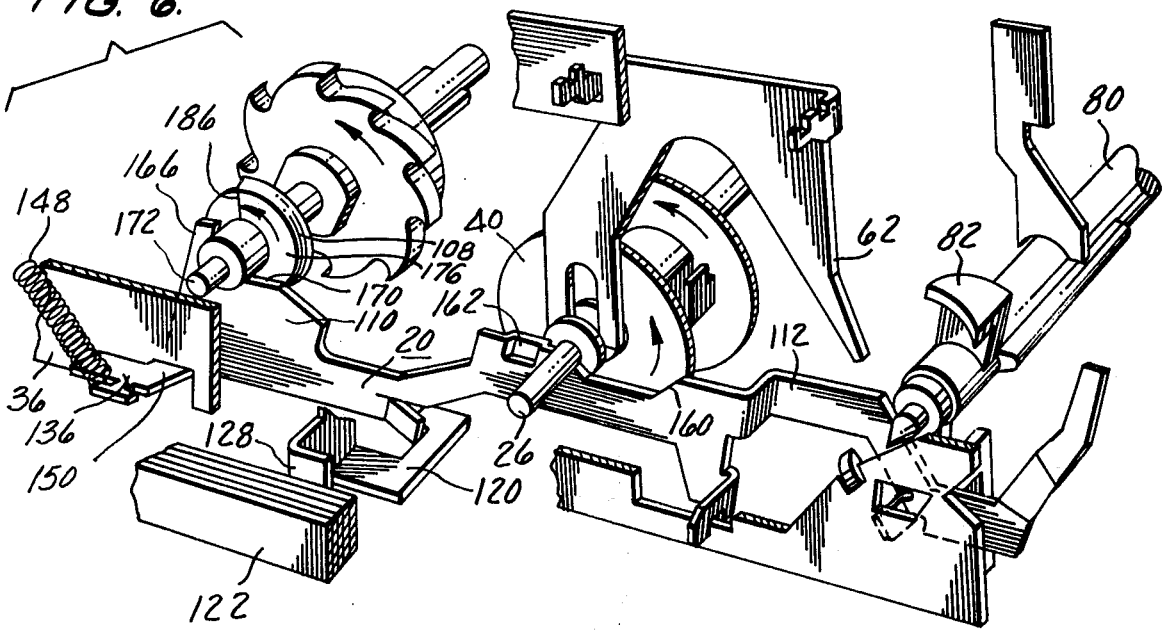
FIG. 6 is a fragmentary exploded rear perspective view generally similar to FIG. 5 showing the parts under the control of a 12 hour alarm time cam gear wherein the alarm time cam gear has functioned to close the switch at the preset alarm time and the 12 hour alarm time cam has also tilted the vibrator shutoff lever into engagement with a minutes cam.

In accordance with my invention, the drive roller 220 for actuating the drive lever 230 of the units display cam 12 is also uniquely utilized for moving the vibrator shutoff lever 20 from its alarm vibrating position illustrated in FIG. 7 to its alarm OFF position illustrated in FIG. 6. As shown more particularly in FIGs. 13, 14, and 15, this is uniquely accomplished by providing a reset pawl 210 for cooperating with the drive roller 220 and the alarm vibrator shutoff lever 20 for moving the shutoff lever 20 from its alarm vibrating position shown in FIGS. 7 and 14 to its alarm shutoff position shown in FIGS. 6 and 15. As shown more particularly in FIG. 13, the reset pawl 210 is mounted on a pawl stud 240 which is pivotally positioned within a downwardly extending slot 244 that is formed in the vibrator shutoff lever 20 for moving the lever.

The upper portion of the reset pawl 210 is formed with a curved cutout portion for selective engagement with the drive roller 220 to permit the drive roller to move the reset pawl 210 and the vibrator shutoff lever 20 from the position illustrated in FIG. 14 to the position illustrated in FIG. 15. A drive lever abutment stud 248 is fixed to the base plate 36 for camming the reset pawl 210 upwardly into a position where it may be engaged by the drive roller 220.

From the foregoing discussion it can be appreciated that the minutes cam 108 actuates the vibrator shutoff lever 20 at the alarm time and spring 148 moves the vibrator shutoff lever to the right (left as shown in FIGS. 6, 7, 14 and 15) to permit the vibrator 128 to sound against the field laminations 122 as shown in FIGS. 7 and 14. In accordance with my unique automatic repeat alarm mechanism, during this rightward movement of the vibrator shutoff lever 20, the reset pawl 210 will be moved into engagement with the drive abutment 248 to move the reset pawl 210 upwardly to a position where it can be contacted by the drive roller 220. As the pawl 210 is carried to the right by its coupling 240, 244 with the vibrator shutoff lever 20 its lower edge engages the abutment 248 which cams the pawl 210 upward to the position where it can be engaged by the drive roller 220.

The engagement of the roller 220 with the pawl 210 occurs three or four seconds after the vibrator has been freed to sound. As the drive roller 220 continues to rotate clockwise (counterclockwise as shown in FIG. 15) it pushes the reset pawl 210 to the left (right as shown in FIG. 15). The stud 240 on the lower end of the pawl 210 is constrained to travel horizontally in the slot 242 which is formed in the base plate 36. The stud 240 is located within the vertical slot 244 of the vibrator shutoff lever and thereby carries the vibrator shutoff lever 20 back to the left (right as shown in FIGS. 6 and 15) with the reset pawl 210 to the alarm reset or shutoff position illustrated in FIGS. 6 and 15. Naturally, this motion of the vibrator shutoff lever 20 will cause the latch 150 of the shutoff lever to be re-positioned within the notch 156 of the base plate 36.

The vibrator shutoff lever 20 now remains latched as the 1 rpm gear 222 continues to rotate and the pawl 210 drops free by gravity and comes to rest on the abutment 248 where it is out of engagement with the drive roller 220. It remains in this position for ten minutes until the alarm shutoff lever 20 is again released by the minutes cam 108 and the cycle repeats with the vibrator sounding and then being automatically shut off in about five seconds of time.

OPERATION

If at bedtime it is desired to have the switch for operating apparatus such as a radio closed at some time in the future, say six o'clock in the morning, and it is also desired to have the audible alarm vibrator 120 vibrate at exactly nine minutes therafter, the selector cam 80 is rotated counterclockwise to the ALARM position shown in FIG. 1. This motion releases the finger 105 of the selector cam 80 from the upwardly extending finger 102 of the vibrator shutoff lever, and the spring 148 holds the latch 150 of the vibrator shutoff lever 20 against the right surface of the latch notch 156. In addition, this motion releases cam 82 of the selector cam 80 from the bifurcated lever 62 to permit the switch 33, 34 to be operated. The alarm set knob 50 is rotated to the six o'clock position illustrated in FIG. 1 and the 12 hour alarm cam gear 40 can now operate to move forwardly to tilt the alarm shutoff lever 20 when finger 46 lines up with the notch formed in the alarm time cam gear 40.

Throughout the night the switch contacts 33, 34 will remain in the open position as the finger 46 of the alarm set cam 42 slides on the forward surface of the continuously rotatable alarm time cam 40. At six o'clock in the morning the finger 46 will have moved to the notch in the alarm time cam and the resilient switch blade 30 will move the lower portion of lever 24 forwardly to move the shaft 26 and the alarm time cam 40 to the position illustrated in FIG. 6. Naturally, during this movement the switch 33, 34 will be moved to its closed position, and more importantly, in accordance with the instant invention, the spring 148 of the elongated alarm shutoff lever 20 will tilt the lever 20 about a hinge line close to the bottom edge of the base plate 36 to move the trigger finger 166 of the alarm shutoff lever 20 into engagement with the minutes cam 108. Then, as the minutes shaft 178 and the cam 108 are rotated clockwise (counterclockwise as shown in the rear perspective view of FIG. 6) the shelf 186 of the cam 108 will move into contact with the upwardly extending trigger finger 166 of the vibrator shutoff lever 20 to move the right portion of the vibrator shutoff lever 20 downwardly to thereby release latch 150 from latch notch 156 to permit the entire shutoff lever 20 to be moved longitudinally to the right (left in FIG. 7) to release the alarm vibrator 120 to sound the alarm at 6:09 in the morning. Thus, at six o'clock the radio will be playing and nine minutes thereafter the vibrator will be sounded and the radio will remain playing.

One of the repeat alarm mechanisms which may be provided for shutting off the alarm vibrator while permitting the radio to stay on includes the repeat alarm bell crank lever 200 illustrated in FIG. 9. With reference to FIGS. 1 and 9, a plunger 218 which extends upwardly from the top wall of the clock may be manually depressed in order to shut off the alarm for a predetermined short time interval, and with particular reference to FIG. 8, it can be seen that depression of the plunger 218 will move the downwardly extending finger 204 of the bell crank 200 to the left (right as viewed in the rear perspective view of FIG. 8) into engagement with the rearwardly extending pivot finger 142 of the vibrator shutoff lever 20 to move the vibrator shutoff lever to the left to thereby pull the vibrator 128 rearwardly to shut off the alarm. During this movement, the latch 150 of the lever 20 will be re-positioned within the latch notch 156 of the base plate 36 to hold the vibrator shutoff lever 20 in the alarm OFF position while the repeat alarm bell crank lever 200 and its plunger member 218 are returned to their upper positions under the force of spring 206. Naturally, during this movement the downwardly extending finger 204 of the repeat alarm bell crank lever will be moved to the right out of the way of the vibrator shutoff lever 20. Thus, the minutes cam 108 can function to resound the alarm a short time interval after the repeat alarm mechanism has been actuated. The shelf 186 of the minutes cam will move into engagement with the upwardly extending trigger finger 166 of the vibrator shutoff lever to move the lever 20 downwardly to release the latch 150 to thereby permit the vibrator 128 to resound.

In order to permanently shut off the audible alarm vibrator 128 the selector cam 80 may be rotated in a clockwise direction from the ALARM position to the RADIO WAKE or the NO WAKE position. With particular reference to FIGS. 2 and 4, it can be appreciated that during this movement the radially outwardly extending cam surface 104 of the selector cam 80 will be moved upwardly from the ALARM position illustrated in FIG. 5 to the RADIO WAKE position or to the NO WAKE position illustrated in FIG. 4, and during this movement the entire vibrator shutoff lever 20 will be moved longitudinally to the left (right in FIGS. 4 and 5) to pull the vibrator 120 away from the field laminations 122 to shut off the alarm.

With reference to FIGS. 6 and 7, it can be appreciated that with the selector cam 80 in the RADIO WAKE position, the alarm vibrator 120 will be prevented from sounding but in this position cam 82 will be spaced from lever 62. Thus, the switch 33, 34 will remain closed and the radio will continue to play while the vibrator 120 is shut off by selector cam 80 – 104.

When the selector shaft 80 and particularly its cam 104 are moved to the position illustrated in FIGS. 2 and 4, it can be appreciated that selector cam 80 – 82 will have engaged lever 62 to move the lever 62, gear 40 and shaft 26 rearwardly to open switch contacts 33 and 34 to thereby shut off the radio. Moreover, during such movement the forwardly extending portion 105 of the cam finger 104 will have pushed the upwardly extending finger 102 of lever 20 rearwardly to tilt the upper portion of the vibrator shutoff lever 20 rearwardly to thereby prevent the lever 20 from being actuated by the 12 hour cam gear 40 and the minutes cam 108. With reference to FIG. 3, it can be seen that this is achieved by uniquely shaping the upwardly extending left finger portion 102 of the vibrator shutoff lever. As shown more particularly in FIG. 2, when the selector cam 80 and its finger 104 are rotated to the position illustrated in FIG. 2, they will tilt the vibrator shutoff lever 20 rearwardly to move the lever 20 a short distance behind the 12 hour alarm time cam 40 and the minutes cam 108 to prevent these cams from actuating the vibrator shutoff lever 20.

From the foregoing discussion, it will be appreciated that my improved alarm vibrator control mechanism may be readily constructed with relatively few parts. The principal component is the uniquely shaped and positioned vibrator shutoff lever 20 which may be readily stamped from a piece of metal to include all of the components for supporting the shutoff lever and for cooperating with the other components of the alarm clock timer. The upwardly extending finger 102 for tilting the vibrator control lever 20 rearwardly can be readily formed during the stamping operation. Likewise, the notched out portion 160 and forwardly extending tab 162 for cooperating with the 12 hour alarm cam 40 may be readily provided during the stamping operation. Similarly, the pivot finger 142 and the upwardly extending trigger tab 166 at the right end portion of the lever for cooperating with the minutes cam 108 can be readily formed during the stamping operation. With this unique mechanism, the latch 150 of the vibrator shutoff lever 20 is located almost directly below the shelf 186 of its actuating cam 108 at the right end portion of the lever so that relatively accurate and positive control of the latch is achieved. The 12 hour alarm time cam gear 40 is required to tilt the entire vibrator lever, and thus, it is uniquely located at the central portion of the vibrator shutoff lever so that the lever actuating protrusion 162 may readily tilt the entire vibrator shutoff lever, and particularly its right end portion into engagement with the cam 108. Moreover, the repeat alarm lever 200 – 204 may be readily positioned adjacent to a tab 142 of the alarm control lever 20 to automatically shut off the alarm for a short time interval.

With my improved vibrator shutoff lever construction, it can also be appreciated that the mechanism may be readily added to a digital clock of the type disclosed in U.S. Pat. No. 3,725,617. The shutoff lever 20 is simply located in existing space in front of the base plate 36, and is readily supported on the base plate by the base plate slots 144 and 156 which receive tabs of the vibrator shutoff lever 20. The shutoff lever 20 is also uniquely shaped so that it may be readily sandwiched between the other components of the digital clock. Thus, an exceedingly simple and reliable mechanism is achieved with the use of relatively few parts which may be readily connected to each other.

What I claim is:

1. A repeat alarm clock mechanism comprising:

a. a timing mechanism;

b. a supporting structure;

c. an alarm vibrator member for sounding an alarm connected to said supporting structure;

d. a vibrator shutoff lever having an alarm on position out of engagement with said vibrator member and an alarm off position in engagement with said vibrator member;

e. a pivot tab integrally formed with said vibrator shutoff lever for mounting said vibrator shutoff lever for pivotal and longitudinal movement on said supporting structure;

f. spring means connected to said vibrator shutoff lever for urging said lever to an alarm on position;

g. a latch integrally formed on said vibrator shutoff lever for holding the vibrator shutoff lever in the alarm off position;

h. means driven by the timing mechanism in selective engagement with a portion of the vibrator shutoff lever for moving the lever to disengage said latch to permit the vibrator shutoff lever to move longitudinally under the force of said spring means to permit the alarm to sound; and i. a repeat alarm lever mounted on said supporting structure, said repeat alarm lever being manually movable into engagement with said pivot tab for moving the vibrator shutoff lever against the force of said spring means to reset said latch to thereby hold the alarm shutoff lever in the alarm off position for a predetermined short time interval.

2. A repeat alarm clock mechanism comprising:

a. a timing mechanism;

b. a supporting structure;

c. a member for sounding an alarm connected to said supporting structure and movable to an alarm on position or an alarm off position;

d. an alarm control lever mounted on said supporting structure and movable into engagement with said member for shutting off the alarm;

e. a pivot tab integrally formed with said alarm control lever for mounting said alarm control lever for movement on said supporting structure;

f. means driven by the timing mechanism in engagement with a portion of the alarm control lever for moving the lever to permit the alarm to sound;

g. a repeat alarm lever pivotally mounted on said supporting structure, said repeat alarm lever being movable into engagement with said pivot tab for moving the alarm control lever to the alarm off position; and h. said means driven by said timing mechanism being positioned for moving the alarm control lever to an alarm sounding position after it has been moved to the alarm off position by said repeat alarm lever.

3. An alarm clock mechanism comprising:

a. a timing mechanism;

b. a supporting structure;

c. a member for sounding an alarm connected to said supporting structure and movable to an alarm on and an alarm off position;

d. an elongated alarm control lever mounted on said supporting structure and movable into engagement with said member for shutting off the alarm, said elongated alarm control lever having a central portion and two end portions;

e. spring means connected to said elongated alarm control lever for urging said lever to a first alarm position;

f. a latch integrally formed on said alarm control lever for holding said alarm control lever in the other alarm position;

g. said alarm control lever being mounted for longitudinal movement to move said member to an alarm sounding position or an alarm off position, said alarm control lever being mounted for tilting movement, and said alarm control lever being mounted for transverse movement;

h. a first cam means driven by said timing mechanism in selective engagement with an end portion of said alarm control lever for moving said lever transversely at a preset time to disengage said latch to permit said elongated alarm control lever to move longitudinally under the force of said spring means to move said member to said first alarm position at a preset time;

i. a second cam means driven by said timing mechanism in selective engagement with the central portion of said alarm control lever for tilting said alarm control lever into engagement with said first cam means a short time prior to said preset time; and j. a rearwardly extending pivot tab integrally formed with said elongated alarm control lever, said tab extending through a slot which is formed in a base plate of said supporting structure and said tab being positioned for engagement with a repeat alarm lever for moving the elongated alarm control lever longitudinally to reset the latch to thereby prevent the alarm from sounding for a short time interval.

4. A repeat alarm clock mechanism comprising:

a. a timing mechanism;

b. a supporting structure;

c. a member for sounding an alarm connected to said supporting structure and movable to an alarm on position or an alarm off position;

d. an alarm control lever mounted on said supporting structure and movable into engagement with said member for shutting off the alarm;

e. a pivot tab integrally formed with said alarm control lever for mounting said alarm control lever for movement on said supporting structure;

f. means driven by the timing mechanism in engagement with a portion of the alarm control lever for moving the lever to permit the alarm to sound;

g. a repeat alarm lever pivotally mounted on said supporting structure, said repeat alarm lever being manually movable into engagement with said pivot tab for moving the alarm control lever to the alarm off position; and h. spring means connected to said repeat alarm lever for moving said repeat alarm lever out of engagement with said pivot tab for permitting said means driven by said timing mechanism to move the alarm control lever to an alarm sounding position.

* * * * *

UNITED STATES PATENT OFFICE

CERTIFICATE OF CORRECTION

PATENT NO. : 3,930,360

DATED : January 6, 1976

INVENTOR(S) : Robert L. Boyles

It is certified that error appears in the above-identified patent and that said Letters Patent are hereby corrected as shown below:

In the specification:

Column 2, Line 31, after "alarm" (first occurrence), insert --. A repeat--.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*